US005605883A

United States Patent [19]

Iliff et al.

[11] Patent Number: 5,605,883

[45] Date of Patent: Feb. 25, 1997

[54] AGGLOMERATED COLORANT SPECKLE EXHIBITING REDUCED COLORANT SPOTTING

[76] Inventors: Robert J. Iliff, 4303 Redwood Dr., Oakley, Calif. 94561; Linda A. Bernard, 2058 Drake Dr., Oakland, Calif. 94611; Erle D. Mankin, 5145 Brookside La., Concord, Calif. 94521

[21] Appl. No.: 554,672

[22] Filed: Nov. 8, 1995

Related U.S. Application Data

[63] Continuation of Ser. No. 339,309, Nov. 14, 1994, abandoned, which is a continuation of Ser. No. 21,715, Feb. 24, 1993, abandoned.

[51] Int. Cl.[6] ..... C11D 11/00; C11D 3/12; C11D 3/14; C11D 3/42

[52] U.S. Cl. ..... 510/444; 8/137; 8/648; 510/301; 510/356; 510/361; 510/507

[58] Field of Search ..... 252/174.25, 174.21, 252/174.24, 89.1, 174.23, 174, 174.13; 23/313 R; 264/117; 8/137, 648

[56] References Cited

U.S. PATENT DOCUMENTS

| | | | |
|---|---|---|---|
| 3,529,923 | 9/1970 | Perry et al. | 8/77 |
| 3,931,037 | 1/1976 | Hall | 252/135 |
| 3,962,116 | 6/1976 | Bloching et al. | 252/301.21 |
| 3,962,132 | 6/1976 | Haschke et al. | 252/430 |
| 4,096,081 | 6/1978 | Phenicie et al. | 252/89 R |
| 4,097,418 | 6/1978 | Rolfes | 252/531 |
| 4,231,887 | 11/1980 | Denny et al. | 252/174.19 |
| 4,264,464 | 4/1981 | Gangwisch et al. | 252/91 |
| 4,379,080 | 4/1983 | Murphy | 252/526 |
| 4,399,048 | 8/1983 | Gangwisch et al. | 252/91 |
| 4,406,808 | 9/1983 | Gangwisch et al. | 252/91 |
| 4,409,136 | 10/1983 | Cheng | 252/540 |
| 4,414,130 | 11/1983 | Cheng | 252/140 |
| 4,419,250 | 12/1983 | Allen et al. | 252/8.6 |
| 4,457,854 | 7/1984 | Gangwisch et al. | 252/91 |
| 4,462,804 | 7/1984 | Gangwisch et al. | 8/137 |
| 4,510,066 | 4/1985 | Saar | 252/140 |
| 4,528,276 | 7/1985 | Cambell | 502/62 |
| 4,605,509 | 8/1986 | Corkill et al. | 252/131 |
| 4,661,293 | 4/1987 | Zielske | 260/377 |
| 4,671,886 | 6/1987 | Mueller | 252/140 |
| 4,707,290 | 11/1987 | Seiter et al. | 252/140 |
| 4,721,633 | 1/1988 | Baldassin | 427/212 |
| 4,746,461 | 5/1988 | Zielske | 260/370 |
| 4,747,880 | 5/1988 | Berrido et al. | 252/135 |
| 4,853,259 | 8/1989 | Taha | 427/221 |
| 4,919,847 | 4/1990 | Barletta et al. | 252/558 |
| 4,997,590 | 3/1991 | Bowling | 252/186.31 |
| 5,024,782 | 6/1991 | Finn | 252/174.13 |
| 5,080,820 | 1/1992 | Grecsek | 252/140 |
| 5,205,958 | 4/1993 | Finn et al. | 252/174.13 |
| 5,256,327 | 10/1993 | Allen et al. | 252/90 |

FOREIGN PATENT DOCUMENTS 59-195521 11/1984 Japan .

*Primary Examiner*—Ardith Hertzog
*Attorney, Agent, or Firm*—Michael J. Mazza

[57] ABSTRACT

The present invention is a granular colorant speckle exhibiting reduced colorant spotting, the speckle which comprises:

(a) an insoluble dispersible carrier;

(b) a surfactant; and (c) a substantive agent.

The present invention also discloses a method for forming a colorant speckle suitable for use as a granular laundry detergent component, or a laundry additive. The speckle of the present invention is preferably produced by an agglomeration process utilizing, for example, a fluid-bed or rotary falling curtain type agglomerator.

17 Claims, No Drawings

AGGLOMERATED COLORANT SPECKLE EXHIBITING REDUCED COLORANT SPOTTING

This is a continuation of application Ser. No. 08/339,309 filed Nov. 14, 1994, now abandoned, which is a continuation of Ser. No. 08/021,715 filed Feb. 24, 1993, now abandoned.

FIELD OF THE INVENTION

The present invention relates generally to bluing speckles for use in laundry products and more particularly to a bluing speckle with reduced blue spotting.

BACKGROUND OF THE INVENTION

One method to offset the yellowing of white garments with age and repeated washings is to introduce a bluing agent, typically an insoluble pigment, during laundering. During laundering, if the bluing agent particles are sufficiently small and dispersed in the laundry solution, the bluing agent becomes deposited onto the fabrics and masks the yellowed color of the fabrics by partially compensating for the absorption of the short wavelength blue. The most common bluing agent is Ultramarine Blue (UMB), a water-insoluble aluminum silicate complex. Care must be taken, however, that the concentration of the blue pigment does not become so localized as to overblue a small area, thus causing a blue spot. This potential for spotting can be overcome somewhat by applying the UMB throughout the detergent or laundry additive, but this will render the product blue in color as well as causing handling problems and contaminating the manufacturing equipment, making it difficult to produce white or other colored products. One can avoid applying the bluing agent to the product base by concentrating the UMB with other low delivery additives in a separate granule or "speckle," but this may enhance the potential for blue spots to be imparted to the laundered items due to the concentration of UMB.

Prior art methods of attempting to reduce such blue spotting include formulating the speckle in a highly soluble matrix such as sodium sulfate. Others have employed a variety of surfactants, for example cationic quaternary ammonium compounds, in effort to disperse the pigments.

It has been surprisingly discovered that, contrary to the teachings of the art, blue spotting can be reduced by a speckle which has an insoluble zeolite as its base. Molecular sieve zeolites have commonly been employed in laundry detergent compositions, as a builder to provide a water-softening function when the detergent or cleanser is placed in an aqueous solution; however, the art has not taught employing such zeolites as a matrix for colorants to reduce fabric staining thereby.

Rolfes, U.S. Pat. No. 4,097,418, describes an agglomerated speckle comprising a colorant and a water soluble salt. Bloching et al., U.S. Pat. No. 3,962,116, describes heat-dried mixtures of optical brighteners and zeolites. Gangwisch et al., U.S. Pat. Nos. 4,264,464 and 4,406,808, both describe spray-dried detergents including a zeolite builder and may include a colorant.

A dry blended granular detergent component comprising a colorant and a "hydratable salt" is disclosed in Hall, U.S. Pat. No. 3,931,037. Zeolites are not disclosed as "hydratable salts." An agglomerated bluing composition is also described in Perry et al., U.S. Pat. No. 3,529,923, and comprises a water soluble inorganic hydratable salt (e.g. sodium tripolyphosphate) and UMB.

Kumatani et al., JP 59-195,221, describes a process for coating granular zeolite with colloidal silica and an inorganic pigment.

U.S. Pat. No. 4,707,290 issued Nov. 17, 1987 to Seiter et al. discloses a spray-dried granular adsorbent for adsorbing liquid ingredients for detergents. U.S. Pat. No. 4,096,081 issued Jun. 20, 1978 to Phenicie et al. discloses particles formed from aluminosilicate, sodium sulfate and polyethylene glycol, initially with about 40% water, by spray-drying, the particulate formed by the above process further being combined with a spray-dried granular detergent product for use as a cleanser.

U.S. Pat. No. 4,379,080 issued Apr. 5, 1983 to Murphy also discloses a granular detergent composition including zeolite as well as other solid and liquid components which were combined with a film-forming polymer soluble in an aqueous slurry. U.S. Pat. No. 4,528,276 issued Jul. 9, 1985 to Cambell discloses the formation of agglomerates of zeolite and silicate by addition of water and application of heat, with tumbling, for use in detergent products.

U.S. Pat. No. 4,414,130 issued Nov. 8, 1983 to Cheng also discloses agglomerates formed from zeolite, a water soluble binder, preferably starch, and a small amount of water.

SUMMARY OF THE INVENTION

It is therefore an object of the present invention to provide a bluing speckle which will yield reduced blue spotting on fabrics laundered therewith.

It is a further object of the present invention to provide a bluing speckle which can also incorporate fragrances, surfactants and the like.

It is a further object of the present invention to provide a highly absorptive speckle which can incorporate high levels of liquid ingredients.

It is a further object of the invention to provide a method of forming a bluing speckle suitable for use as a detergent booster or as a granular detergent component, the method including the steps of preloading carrier particles with a surfactant, and agglomerating the preloaded bluing with the remaining dry ingredients and a binder to yield a speckle having a mean particle size of about 500–1000 microns and density ranging from about 0.4 g/cm$^3$ to 0.8 g/cm$^3$, depending on the agglomeration process used, while being characterized by uniform particle size, mechanical particle strength sufficient to resist particle fracture and good solubilization/dispersion qualities in aqueous solution.

It is another object to produce a speckle which can be produced by an energy efficient process.

Additional objects and advantages of the invention are made apparent in the following description of preferred embodiments of the invention.

DESCRIPTION OF THE PREFERRED EMBODIMENT

A first embodiment of the present invention is a granular speckle which comprises:

(a) an insoluble dispersible carrier;

(b) a surfactant; and (c) a substantive agent.

As outlined above, the present invention also discloses a method for forming a bluing speckle suitable for use as a granular laundry detergent component, or a laundry additive. The speckle of the present invention is preferably produced by an agglomeration process utilizing, for example, a fluid-bed or rotary falling curtain type agglomerator.

With either agglomeration process, it is most preferred to preload carrier particles with surfactant prior to agglomeration. The preloading step may employ a blender or mixer, and preferred is a ribbon blender or Littleford type mixer. The various objects and advantages of the invention as summarized above are described in greater detail below.

Carrier

A principal component of the bluing speckle is an insoluble, dispersible carrier particle, having a particle size of less than about twenty microns, preferably less than about ten microns and most preferably less than about seven microns. The particle size range is selected to be small enough to pass through the weave of a typical fabric, affording dispersibility to the carrier. Preferred carriers are inorganic compounds such as zeolites, aluminas, silicas and calcium carbonate. Organic materials, such as polymers, may also be suitable provided they are within the preferred size range and have a suitable charge potential. Most preferred are zeolites, which are synthetic alumino-silicates based on the anhydrous formula $Na_2O.Al_2O_0$, $SiO_2$. Either a single zeolite or a combination of zeolites of the type generally referred to as detergent grade zeolites which are well known to those skilled in the art and which typically have a particle size in the range of about 1–20 microns are contemplated for use herein. Zeolites are particularly preferred carriers as they also perform their active water softening function. In the product, zeolites do not impair the hue of the bluing agent, since the zeolite appears white to the observer.

The carrier is present in an amount generally in the range of about 10–90 weight percent, preferably about 20–80 and more preferably about 30–60 weight percent.

Surfactant

The surfactant functions primarily as a processing aid for the carrier, and also acts to facilitate the dispersion of the fine insoluble carrier particles, especially where zeolite is the carrier. Preferred surfactants are the nonionics, for example, polyethoxylated alcohols, ethoxylated alkyl phenols, anhydrosorbitols, and alkoxylated anhydrosorbitol esters. An example of a preferred nonionic surfactant is a polyethoxylated alcohol manufactured and marketed by the Shell Chemical Company under the trademark "Neodol". Examples of preferred Neodols are Neodol 25-7 which is a mixture of 12 to 15 carbon chain length alcohols with about 7 ethylene oxide groups per molecule; Neodol 23-65, a $C_{12-13}$ mixture with about 6.5 moles of ethylene oxide; Neodol 25-9, a $C_{12-13}$ mixture with about 9 moles of ethylene oxide; and Neodol 45-7, a $C_{14-15}$ mixture with about seven moles of ethylene oxide. Other nonionic surfactants useful in the present invention include trimethyl nonyl polyethylene glycol ethers such as those, manufactured and marketed by Union Carbide Corporation under the Trademark Tergitol, octyl phenoxy polyethoxy ethanols sold by Rohm and Haas under the Trademark Triton, and polyoxyethylene alcohols, such as Brij 76 and Brij 97, trademarked products of Atlas Chemical Co. Certain amphoteric surfactants, most notably betaines, and anionics, principally alkyl aryl sulfonates and alkyl ether sulfates, are also within the scope of the present invention. Other surfactants may be equally suitable, depending on their hydrophiliclipophilic balance (HLB), which preferably should be below about 13, and more preferably below 10.

The surfactant is added in an amount sufficient to provide the processing benefit, generally about 1 to 45% by weight, more preferred is 5 to 25% by weight, and the most preferred range is about 12 to 20%. Where an agglomeration process is used, and where zeolite is the carrier, it is preferred that a ratio of carrier:surfactant fall within the range of about 2:1 to 5:1, more preferably about 3:1 to 4:1. It is within the scope of the invention to use mixtures of any of the above surfactants.

Substantive Agent

The present invention contemplates a substantive agent, preferably a colorant, especially one having a positive zeta potential, and most preferably one which is also insoluble. Since fabric fibers tend to be negatively charged, the positive zeta potential of the substantive agent promotes deposition onto the fabric surface. Foremost among these is Ultramarine Blue (UMB), a water-insoluble aluminum silicate complex. In general, substantive blue colorants are contemplated for use herein. Other colorants capable of forming a part of the speckle herein include dyes such as Monastral blue and anthraquinone dyes such as those described in Zielske, U.S. Pat. Nos. 4,661,293, and 4,746,461, the disclosures of which are incorporated herein by reference. As previously discussed, when deposited onto a white fabric which has yellowed, the blue coloring tends to cancel the observed yellow color, making the fabric appear white again. However, any substantive agent, including colorants other than blue, could be incorporated into the present invention where such agent may benefit from improved dispersibility. By way of example a white pigment, such as titanium dioxide, may be incorporated into a speckle where a white colorant is desired. Mixtures of any of the foregoing substantive agents can be employed. The substantive agent is present in a substantive-effective amount, and forms from about 1–30 weight percent of speckle, preferably about 1–10 weight percent, more preferably about 2–9 weight percent, and most preferably about 3–8 weight percent.

Optional Ingredients

A fluorescent whitening agent (FWA), also referred to as a brightener, is a preferred optional ingredient. Such products are fluorescent materials, often substituted stilbenes and biphenyls, and have the ability to fluoresce by absorbing ultraviolet wave-lengths of light and re-emitting visible light, thus making fabrics laundered therewith brighter and whiter. Preferred fluorescent whitening agents include substituted stilbene disulfonic acid products sold by the Ciba Geigy Corporation under the trade name "Tinopal". Preferred Tinopal products are Tinopal 5BM, Tinopal UNPS, Tinopal CBS and Tinopal RBS. The fluorescent whitening agent is present in a whitening-effective amount, typically is from about 0 to about 40% by weight of the speckle. More preferred is about 1–30% by weight, and most preferred is about 5–20%. Also suitable is Mobay Chemical Corporation's Blankophor HRS. The brightener should be added in the salt or neutralized form in order to avoid reactions with UMB.

Other optional ingredients include fillers which may be combined with the carrier in order to enhance interactions necessary for forming the agglomerate. Fillers especially sodium chloride may be added when it is desired to obtain a higher bulk density agglomerate. The filler preferably includes a substantial portion of an inorganic salt such as sodium chloride having a low degree of absorptivity. In addition, the filler may be a filler/builder with other components serving also as co-builders with the zeolite carrier and performing additional functions as well as agglomerate as set forth below, the filler/builder preferably includes various amounts of inorganic salts, carbonates, sulfates, citrates, borax, borates and/or perborates, clays, bicarbonates, phosphates, silicates, silicas, acetates, etc. Although the perborate is capable of functioning as a filler in the zeolite agglomerate, it otherwise performs as an oxidant rather than as a builder. The speckle of the present invention could also function as a vehicle to deliver low level performance chemicals, for example cosurfactants, enzymes, oxidants, bleach activators, and fragrances. Fillers and adjuncts may be added in an amount of from 0 to about 40 weight percent.

A second embodiment of the present invention is a bluing speckle comprising:

(a) about 10–90 weight percent of a zeolite;

(b) about 1–20 weight percent of a surfactant;

(c) about 1–10 weight percent of a bluing agent;

(d) about 15–40 weight percent filler: and (e) about 0–40 weight percent adjuncts and wherein the speckle contains no more than about 8% water.

Process

The initial process or method of agglomeration is carried out principally in a fluid bed or rotary drum agglomerator. It is preferred that an agglomeration process be used, and most preferably a two-step agglomeration process wherein the carrier, especially zeolite, is initially preloaded with surfactant in a blender and the surfactant/carrier particle then agglomerated with the substantive agent and with the remaining dry ingredients, plus a binder. However, it is within the scope of the present invention to prepare the speckle in a one-step process wherein all the dry ingredients are blended or agglomerated with the liquid ingredients in a single apparatus.

The binding agent for the agglomeration process preferably used to produce the speckle may be any of a number well known to those skilled in the art, and preferably comprises polyacrylate in order to achieve the optimum physical particle characteristics of the invention. However, the binder could also be a polyethylene glycol (PEG) or a carboxymethyl cellulose (CMC). Mixture of binders may also be suitable.

Both homopolymers and copolymers of various types are suitable. An example of a commercial source for such a product is the series of polyacrylates available under the trade name ALCOSPERSE.

Where the two-step process is used, preloading of surfactant is preferably accomplished in a blender. Acceptable types of blenders include pugmills, paddle blenders, conical batch blenders, ribbon blenders, Vee blenders, and plow blenders. Most preferred is a plow blender with chopper blades, particularly those manufactured and marketed by Littleford.

From the blender, the preloaded carrier is then charged to an agglomerator, along with remaining dry ingredients and agglomerated with the binder to produce the speckle. Optionally, the speckle may be dried upon discharge from the agglomerator. Preferred agglomerators include vertical turbo types such as those manufactured and marketed by Schugi, or fluid-bed type agglomerators such those manufactured and marketed by Glatt or Aromatic. These agglomerators utilize an upward air stream to fluidize the dry particles within the agglomerator. Also preferred is a rotary falling curtain type agglomerator such as that known in the trade as an O'Brien agglomerator. Where the O'Brien rotary agglomerator is employed, the carrier particles and other dry components, principally one or more filler components and the surfactant are pre-mixed in a separate mixer, e.g. a pugmill, but may also be combined and pre-mixed in the O'Brien agglomerator. In any event, a binding-effective amount of the binder, preferably polyacrylate, is then sprayed onto the carrier from the prior mixing step together with continuous mixing produced by the O'Brien agglomerator in order to produce the agglomerated product. In the O'Brien agglomerator, the tumbling or rolling action of the drum allows granules formed from the carrier and other solid components together with the binder to gradually increase in size.

The process used to agglomerate the bluing speckle is important in that it may determine the physical characteristics, e.g. particle size distribution (PSD), density, and mechanical strength of the resulting speckle. In general, a stronger, higher density speckle with a more preferred particle size distribution results when agglomeration is carried out in the O'Brien agglomerator. The speckle produced by the preferred process of the present invention is thus characterized by particularly uniform size particles and by excellent dispersion characteristics and absence of blue spotting. Without intending to be bound by theory, it is presumed the carrier, e.g. zeolite is able to compete with the substantive agent, e.g. the UMB for those sites on the nearby fabric which might capture the substantive UMB particles. Since the white zeolite is also insoluble, and since its particle size (less than seven microns) has been specially engineered to pass through the weave of the fabric, the zeolite floods the fabric area closest in contact with the dissolving speckle, temporarily blocking the UMB from occupying several adjacent sites which would cause blue spotting. When agitation begins, the zeolite is washed from the fabric leaving the UMB uniformly deposited on the total fabric area.

It may also be desirable to use a rotary O'Brien type agglomerator in series with a vertical turbo agglomerator, as disclosed in commonly-owned Finn et al., U.S. Pat. No. 5,024,782, the disclosure of which is incorporated herein by reference.

In addition, the speckle of the present invention, is particularly characterized by improved mechanical strength sufficient to resist particle fracture. Mechanical strength or frangibility of the speckle has been found to be suitable for permitting transfer of the agglomerate by conventional pneumatic conveying machines without significant fracture of the particles.

A third embodiment of the present invention is a bluing speckle for laundry products, the speckle comprising:

(a) about 10–90 weight percent of a zeolite;

(b) about 5–40 weight percent sodium chloride;

(c) about 3–8 weight percent ultramarine blue (d) about 1–10 weight percent nonionic surfactant (e) about 10–30 weight percent brightener, (f) about 1–8 weight percent binder; and wherein the speckle has a mean particle size of about 500–1000 microns, a bulk density of about 0.4–0.8 g/cm$^3$ and includes no more that about 8% water.

An exemplary speckle formula follows. Resulting physical characteristics are provided for the speckles produced by the rotary and fluid-bed agglomeration processes. All percentages are weight percentages, and mesh sizes are U.S. mesh.

| Ingredient | Range |
|---|---|
| Zeolite | 24–40% |
| Filler | 10–30% |
| Brightener | 24–28% |
| UMB | 3–8% |
| Surfactant | 7–12% |
| Binder | 5–7% |
| $H_2O$ | 0–5% |

1. Rotary Process Physical Characteristics:
Bulk Density 0.66–0.71 g/cm$^3$

| PSD | |
|---|---|
| 12 mesh | 0.2–3% |
| 16 mesh | 5.6–13.4% |
| 20 mesh | 33.4–48.4% |
| 40 mesh | 93.5–97.9% |
| 60 mesh | 99.0+% |

2. Fluid Bed Process:
Bulk Density 0.45–0.50 g/cm$^3$

| PSD | |
|---|---|
| 12 mesh | 0.7–1% |
| 16 mesh | 1.8–3.6% |
| 20 mesh | 12.1–24.4% |
| 40 mesh | 71.9–83.3% |
| 60 mesh | 91.0+% |
| 80 mesh | 96.0+% |

Experimental

The speckles were tested to evaluate blue spotting under a stressful misuse condition by having a high concentration (8%) of UMB in contact with fabric. The speckle was made by spraying the powder ingredients with surfactant in a Hobart mixer. This mixture was then screened through a 12 mesh prior to agglomerating in the Aromatic. The speckles tested were formulated as follows:

| Formula I | |
|---|---|
| Ingredient | Wt % |
| Zeolite | 58.6 |
| Surfactant | 14.0 |
| Tinopal | 13.6 |
| UMB | 8.2 |
| Alcosperse | 3.3 |
| Water | 2.3 |
| TOTAL | 100.0 |

One-half gram of speckles is sprinkled onto softened and unsoftened swatches. (Softened swatches were prepared by running them through a standard machine wash cycle with a commercially-available cationic fabric softener, followed by drying.) The amount of speckles is adjusted to ensure that the amount of UMB on the swatches remains the same for comparison. The swatch is soaked for 15 minutes in 50 ml of liquid (either aleionized (DI) water or detergent solution). The swatch is dried at 62° C. for 30 minutes, then hand rinsed in DI water, followed by drying again at 62° C. for 30 minutes. Finally, colorimeter readings are taken of the resulting blue spot.

The blue spots that formed on the swatches were measured with a Hunter colorimeter. This instrument measures light reflected from the swatch, dividing the light measurement into three values, one measuring darkness to lightness, and two measuring color (hue). The two which measure color are based on "opponent color" theory: i.e. they measure a test color's distance along an axis from one reference color to its opponent reference color.

The three values are referred to as "L", "a", and "b", and represent:

L=Black to White a=Green to Red b=Blue to Yellow

The test protocol measured the change in these values to determine how much of blue pigment is deposited on a clean white swatch after contact with the speckles. Therefore, the needed calculation is the difference, or Δ, between the blue deposit and the original "color" (i.e. white) of the initial clean swatch.

Δb measures only the blue color that was deposited on the clean swatch, and will be smaller or more negative when more blue is deposited, because blue colors fall along the negative portion of the blue-to-yellow color axis.

ΔE is a composite measure that includes all three values, and measures not only how much blue is added, but how "dark" the spot is, and is calculated:

$$\Delta E=[(\Delta L)^2+(\Delta a)^2+(\Delta b)^2]^{1/2}$$

where L, a, and b are measured before and after soaking on a blue spot to yield the Δ's. For a darker spot ΔE will usually be larger, in response to the larger change in L and b values. Clean, scoured swatches were used as a reference point. A ΔE therefore indicates how much the spotted swatch deviates from the clean swatch in terms of overall color change, while a Δb value indicates the specific color change of the swatch. Higher UMB deposition is indicated by higher ΔE values and a lower (more negative) Δb. Tables I below shows results for swatches soaked in DI water, while Table II shows results from swatches soaked in detergent solution.

TABLE I

| Example | Average Δb | Average ΔE |
|---|---|---|
| Control[a] | −21.47 | 34.23 |
| 1[b] | −16.32 | 24.78 |
| 2[b] | −11.61 | 20.00 |
| 3[c] | −15.80 | 23.91 |
| 4[c] | −14.42 | 22.32 |

[a]sodium sulfate in place of zeolite
[b]unsoftened swatch
[c]softened swatch

TABLE II

| Example | Average Δb | Average ΔE |
|---|---|---|
| Control[a] | −21.47 | 34.23 |
| 1[b] | −14.26 | 22.43 |
| 2[b] | −14.25 | 22.52 |
| 3[c] | −14.57 | 22.67 |
| 4[c] | −14.55 | 22.27 |

[a]sodium sulfate in place of zeolite
[b]unsoftened swatch
[c]softened swatch

Effect of Surfactant on Blue Spotting

Various surfactants were added to zeolite based speckles to determine their effect on blue spotting reduction. Surfactants reduce the surface tension between water (the wash liquor) and the insoluble particles, ( i.e. they improve wetting) thus surfactants cause the speckles to disperse faster in solution. Surfactants also act to coat the insoluble particles in the speckles, thereby improving dispersibility, thus reducing blue spotting. The speckles used in this experiment were also made up according to Formula I. Results are shown in Table III.

TABLE III

Effect of Surfactants in Speckles Formula

| Surfactant Name | Chemical Name | Average Δb | Average ΔE |
|---|---|---|---|
| Control[1] | | −16.35 | 26.73 |
| Neodol 25-9 | alcohol ethoxylate | −12.33 | 20.57 |
| Neodol 91-2.5 | alcohol ethoxylate | −3.92 | 12.41 |
| Triton X-100 | octyl phenoxy polyethoxy ethanol | −13.48 | 21.57 |
| Shell AE/AES | Alcohol ethoxylate/alcohol ethoxysulfate | −8.79 | 17.70 |
| Bardac LF | di-octyl dimethyl ammonium chloride | −11.69 | 17.71 |
| Lonzaine CO | cocoamido betaine | −13.34 | 22.61 |

[1]sodium sulfate carrier; no surfactant

No statistical difference in the effects among the nonionic, and anionic surfactants was observed; the amphoteric performed only slightly worse than the others.

The hydrophilic-lipophilic balance (HLB) number of nonionic surfactants was observed to determine its effect on blue spotting (as measured by average ΔE), and results are shown in TABLE IV below. Detergent solution was used to soak the swatches, as outlined above.

TABLE IV

Effect of HLB Number

| Surfactant | HLB Number | Fabric | Average ΔE |
|---|---|---|---|
| Neodol 91-2.5 | 8.1 | Softened | 11.0 |
| | | Unsoftened | 15.0 |
| Neodol 25-9 | 13.3 | Softened | 16.0 |
| | | Unsoftened | 22.9 |
| Triton X-100 | 13.5 | Softened | 16.6 |
| | | Unsoftened | 24.3 |

The results suggest that as the HLB number decreases, the blue spotting also decreases. This effect was most evident in the case of speckles on unsoftened swatches.

There have thus been described above a number of variations of bluing speckles suitable for use by themselves or in detergent compounds, and methods for forming the speckles. Accordingly, the scope of the present invention is defined only by the following appended claims which are further exemplary of the invention.

What is claimed is:

1. A colorant speckle exhibiting reduced spotting consisting essentially of:

(a) 20–80 weight percent of a zeolite having a particle size of less than about 20 microns;

(b) 5–25 weight percent of a nonionic surfactant;

(c) 1–10 weight percent of a an insoluble substantive colorant having a positive zeta potential;

(d) 1–8 weight percent of a binding agent; and (e) 0–8 weight percent water; and wherein the speckle is produced by an agglomeration process, has a ratio of zeolite:surfactant of about 2:1 to 5:1 and the speckle exhibits reduced colorant spotting as determined by an average ΔE value.

2. The speckle of claim 1 wherein the colorant is a pigment.

3. The speckle of claim 2 wherein the pigment is ultramarine blue.

4. The speckle of claim 1 wherein the surfactant has a hydrophilic-lipophilic balance of less than about 13.

5. The speckle of claim 1 wherein the substantive colorant is Ultramarine Blue, the zeolite is present in an amount of 30–60 weight percent, and the nonionic surfactant has a hydrophilic-lipophilic balance below about 13.

6. The colorant speckle of claim 1 wherein colorant spotting is reduced at least 9.45, as determined by an average ΔE value.

7. A colorant speckle which comprises a plurality of particles of zeolite, each having a particle size of less than about twenty microns, and having adsorbed thereon a nonionic surfactant in a zeolite:nonionic surfactant ratio of about 2:1 to 5:1, the zeolite particles being co-agglomerated with a binder and with a colorant particle and a brightener particle, the resulting speckle comprising about 20–80 weight percent carrier, about 1–30 weight percent insoluble substantive coloring agent, having a positive zeta potential, and about 5–25 weight percent nonionic surfactant, and having a density of about 0.4–0.8 g/cm$^3$ and a mean particle size of about 500–1000 microns and wherein the speckle exhibits at least about 33% reduced colorant spotting as determined by an average E value.

8. The colorant speckle of claim 7 wherein colorant spotting is reduced by at least 9.45 as determined by an average ΔE value.

9. In a laundering method for offsetting yellowing of fabrics, the method comprising laundering the fabrics with a bluing agent, the improvement which comprises adding to a wash solution an agglomerated bluing speckle comprising 20 to 80 weight percent of a zeolite carrier having a particle size of less than about 20 microns, 3 to 8 weight percent of an insoluble bluing agent, 1 to 8 weight percent of a binder, 0 to 40 weight percent of a brightener, and wherein the speckle contains no more than about 8 weight percent water, has a density of about 0.4 to 0.8 g/cm$^3$ and a mean particle size of about 500–1000 microns and wherein the speckle exhibits reduced colorant spotting as determined by an average ΔE value.

10. A method of forming a colorant speckle suitable for use as a ganular detergent component or a detergent booster, comprising the steps of (a) preloading a plurality of particles of a zeolite, carrier, having a size of less than about 20 microns, with a nonionic surfactant;

(b) charging a quantity of the preloaded carrier particles, plus a quantity of a dry insoluble substantive coloring agent, having a positive zeta potential, to an agglomerator; and (c) spraying a binding effective amount of a binder onto the dry particles in the agglomerator; and (d) discharging the resulting agglomerated product; and whereupon the speckles comprise about 20–80 weight percent carrier, about 1–30 weight percent substantive coloring agent, and about 5–25 weight percent nonionic surfactant, and have a mean particle size of about 500–1000 microns and a density of about 0:4–0.8 g/cm$^3$, while being characterized by good dispersion qualities in aqueous solution and wherein the speckle exhibits reduced colorant spotting as determined by an average $\Delta E$ value.

11. The method of claim 10 wherein the substantive coloring agent is a blue colorant.

12. The method of claim 11 wherein the blue colorant is ultramarine blue.

13. The method of claim 10 wherein the agglomerator is a rotary agglomerator forming a falling curtain of the dry ingredients.

14. The method of claim 10 wherein the agglomerator is a fluid-bed agglomerator.

15. The method of claim 10 wherein the binder is selected from the group consisting of a polyacrylate, PEG, and combinations thereof.

16. The method of claim 10 wherein the binder comprises polyacrylate.

17. The product of the method of claim 10.

* * * * *